US005293891A

United States Patent [19]

Cordes et al.

[11] Patent Number: 5,293,891

[45] Date of Patent: Mar. 15, 1994

[54] PROCEDURE AND FACILITY FOR DISPATCHING AGENT FROM AT LEAST ONE HOLDING POINT TO AT LEAST ONE PROCESSING POINT

[75] Inventors: Carl P. Cordes, Schwäbisch Hall; Victor Thamburaj, Michelbach/Bilz, both of Fed. Rep. of Germany

[73] Assignee: THEN-Maschinen- und Apparatebau GmbH, Hessental, Fed. Rep. of Germany

[21] Appl. No.: 844,798

[22] Filed: Mar. 2, 1992

[30] Foreign Application Priority Data

Mar. 8, 1991 [DE] Fed. Rep. of Germany ..... 4107478

[51] Int. Cl.[5] ..... F16K 11/20

[52] U.S. Cl. ..... 137/1; 137/597

[58] Field of Search ..... 137/1, 597, 606, 599

[56] References Cited

U.S. PATENT DOCUMENTS

| | | | |
|---|---|---|---|
| 1,566,605 | 12/1925 | Jamison | 137/597 X |
| 1,991,851 | 2/1935 | Hammell | 137/597 X |
| 2,031,614 | 2/1936 | McKee et al. | 137/597 X |
| 2,500,239 | 3/1950 | Beyette | 137/597 |
| 2,694,407 | 11/1954 | Jobson | 137/505.12 X |
| 3,392,747 | 7/1968 | Waldrop | 137/597 |
| 4,270,570 | 6/1981 | Kolze | 137/597 |
| 4,444,215 | 4/1984 | Zukausky | 137/597 X |
| 4,627,457 | 12/1986 | Bird et al. | 137/1 |
| 4,632,147 | 12/1986 | Whaley | 137/597 X |
| 4,816,083 | 3/1989 | Bangyan | 137/606 X |

FOREIGN PATENT DOCUMENTS

| | | |
|---|---|---|
| 2723623 | 11/1978 | Fed. Rep. of Germany . |
| 0277365 | 9/1988 | Fed. Rep. of Germany . |
| WO-A-8603235 | 6/1986 | PCT Int'l Appl. . |

*Primary Examiner*—Stephen M. Hepperle

*Attorney, Agent, or Firm*—Frishauf, Holtz, Goodman & Woodward

[57] ABSTRACT

To dispatch a treatment agent, such as a reagent, process promoter, dye, softener and the like used in textile finishing from a specific holding station (1) to a processing point (2), a control unit (140) is provided to selectively open and close valves (8, 11) to respectively block and release branch lines and establish at least one of several possible flow itineraries from each holding point through a selected branch (6) and then to at least one header (3; 300), them from the header or headers through a trunk line (5) to at least one distributor (4; 400) and, then, from the distributor or distributors through at least one other branch (9) to the selected processing point or points; once the communication line or itinerary is established, the treatment agent is released from the holding point or points to the selected processing point or points.

24 Claims, 5 Drawing Sheets

PROCEDURE AND FACILITY FOR DISPATCHING AGENT FROM AT LEAST ONE HOLDING POINT TO AT LEAST ONE PROCESSING POINT

FIELD OF THE INVENTION

The present invention concerns a procedure and a facility for dispatching agent from at least one holding point to at least one processing point as needed. The points may be part of a textile-finishing plant. The agent may be a liquid or gas. It may also be in the form of solid particles, as long as they will flow readily.

BACKGROUND OF THE INVENTION

Reagents (e.g. acetic acid), process promotors (e.g. softeners), and dyes—all called agents hereinafter—are employed in the textile-finishing industry in specific processing machinery and equipment.

How much of each agent is needed for a specific processing stage is often prescribed in a recipe. The agent for each stage in the finishing of a textile must be portioned or metered out and dispatched to the corresponding machinery or equipment. The various amounts are often dissolved or fine-dispersed in liquids (e.g. water). In this event the liquid can also act as a carrier. Agent is in the simplest case brought to the textile-finishing machinery or equipment by hand, in pails for example, and there added either directly to the machinery or equipment or to a storage container (e.g. the feed tank of a dye vat). Automating the procedure is known. Holding tanks (e.g. feed tanks or solution tanks) installed at a central point, in the kitchen of the dye works for example, can communicate through pipelines with the machinery or equipment. When agents have to be dissolved, in water for example, the containers often have mixers, heaters, and other auxiliary equipment associated with them. The ensemble of such a container and its associated auxiliary equipment will be called a holding point hereinafter, although the term is not to be considered as exclusive. Such a holding point can also have instead of the auxiliary equipment a line that supplies it with agent from a production line through a dosimeter. Large volumes of agent can be kept on hand at such a holding point. Enough for the particular stage can be removed and dispatched to the processing point. It is on the other hand also possible to prepare and hold one or more batches of just enough agent for the particular stage and dispatch it to the processing point as needed.

The processing points in what follows are to be understood as each comprising specific processing machinery and equipment (e.g. dying machines or scouring becks), in which the textile is processed by adding the agent.

One type of facility for automatically dispatching agents to processing points from holding points is comparatively simple and extensively employed. Each machine and piece of equipment is associated with its own holding tank by way of an unbranched pipeline. When there are several machines or pieces of equipment, as at a processing point for example, this approach demands relatively many holding tanks, holding points in other words. The pipeline is expensive, and a lot of space is consumed. Again, since the lines are usually very long, they are inefficient to operate.

Such facilities are accordingly often recirculating or branched to allow the processing points to be alternately connected to and disconnected from the various holding points by valves. Although such a facility does make it possible to get along with less holding tanks and points than an unbranched facility can, it is, with all its pipelines and valves, considerably more complicated and expensive.

THE INVENTION

It is an object to provide a procedure and facility of the aforesaid type that will flexibly dispatch the various requisite processing agents from as few holding points as possible to as many processing points as possible without unduly complicating the system of pipelines and hence consuming a lot of space.

This object is attained in accordance with the invention in a procedure with the features that will no be described.

Controls open and close flow regulators that block and release branches, establishing at least one of several possible itineraries. The first part of the itinerary extends from each holding point, through a branch, and to at least one header. The second part extends from the header or headers, through at least one trunk, and to at least one distributor. The third from the distributor or distributors, through at least one other branch, and to the processing point or point. Once the itinerary has been established, agent is dispatched from the holding points to the processing points over the itinerary.

The headers are adjacent to the holding points, which communicate with them through branches. The distributors are adjacent to the processing points and communicate with them through other branches. The trunk between the header and distributor makes it possible, often with only a single length of pipeline, to establish a route that can be operated at high efficiency and low expenditure in little space. High flexibility is simultaneously ensured by the "intelligent" pipeline with its controlled headers and distributors and trunk, that make it possible to establish the correct itinerary for dispatching each type of agent from its holding point to the processing point where it is needed.

Significantly, the number of holding points (and hence the number of dissolving and solution tanks) no longer depends on the number of processing points being serviced but only on the processing parameters.

The itineraries can be established between groups of holding points and/or groups of processing points instead of between individual points.

The headers and distributors are rinsed before and/or after agent has traveled through them. Rinsing might be carrie for example to remove deposits or encrustation of dry or crystallized processing agent from the inner surfaces or because the residue of one agent that has just traveled through them might contaminate another agent that is about to travel through them. The headers and distributors are rinsed whether or not an individual holding or processing point is rinsed. The trunk can also be rinsed.

It can also be of advantage to optionally return processing agent from a processing point to a holding point over an itinerary established through a distributor, the trunk, and a header—to reverse the direction of travel in other words.

Serial and/or parallel itineraries can also be established through headers and distributors.

Rinse can be left in all or part of the facility subsequent to a rinsing procedure.

One example of how the procedure in accordance with the invention can be of advantage involves the addition of salt to a dying machine. The salt is dissolved in water to make a brine. The brine is then added to the machine in the capacity of a processing agent, incidentally extending the liquor ratio. Such an extension is generally considered a drawback. If on the other hand some of the liquor is transferred from the machine to a dissolving tank at the holding point, the salt can be dissolved inside it and the resulting brine returned to the dying machine. Only a little more water will need to be added to dissolve the salt.

The procedure in accordance with the invention can obviously be very flexibly adapted to various operations.

A facility for carrying out the procedure has at least one holding point that communicates with at least one processing point. It is characterized by the features now described.

First, it has a pipeline with branches, connections accommodating flow regulators that can block or release each branch, at least one header, at least one trunk, at least one distributor, and at least one manifold in each header and distributor. Each holding point communicates with a header through a branch by way of a connection that has a flow regulator accommodated therein. Each header communicates either with another header through branches and flow regulators accommodated therein or with a distributor through one or more trunks. Each distributor communicates either with another distributor through flow regulators and branches or with at least one processing point through further branches by way of a connection that has a flow regulator accommodated therein. Second, it has controls electrically connected to each flow regulator by lines.

Both the holding points and the processing points can be in groups. In this event, each group will communicate with a header, at least one header will communicate with another header, at least one distributor will communicate with another distributor, and a distributor will communicate with each group.

It is of particular advantage for the manifolds to be accommodated in tubular housings. The tubular housing minimizes dead space and allows unexceptionable rinsing between dispatching operations, with the expenditure in rinse being relatively low. The connections can then be distributed along each housing. The flow regulators can be valves. Each valve can communicates with a connection and can have a head. The head can operate in conjunction with the connection. The valves can accordingly be replaced and repaired individually without having to disestablish the connections.

Connectors communicating with at least one trunk and/or at least one rinse line can be flanged onto the ends of one or more housings. Means of regulating the flow through the connectors can be positioned at least at one end of the housing. The connectors can communicate through a bypass, which will also allow injection or extraction at each end of the housing. The bypass can also communicate with at least one trunk.

Although there is generally only one trunk, the facility can have several parallel trunks.

Each group of holding points and/or processing points can have its own manifold. The manifolds can communicate over appropriate itineraries with connections with at least one parallel or downstream manifold. Each connection can accommodate flow regulators. The trunk or trunks can extend to the one or more manifolds.

At least one holding point can have a dosimeter for portioning out agent communicating directly with the connection into its associated manifold. The advantage is that the downtime involved in rinsing a particular tank is much shorter, because the tank only has to be provided with rinse until it is clean. The trunk can then be rinsed directly, from the headers for example, which are rinsed simultaneously with the distributors The additional function of the header and/or distributor decreases the number of or requisite holding tanks even more.

Some preferred embodiments of the invention will now be specified with reference to the drawing.

BRIEF DESCRIPTION OF THE DRAWING

FIG. 6 is a schematic illustration of the header or distributor illustrated in FIG. 3 that processing agent can flow axially through.

DETAILED DESCRIPTION OF THE PREFERRED EMBODIMENTS

Figure 1:
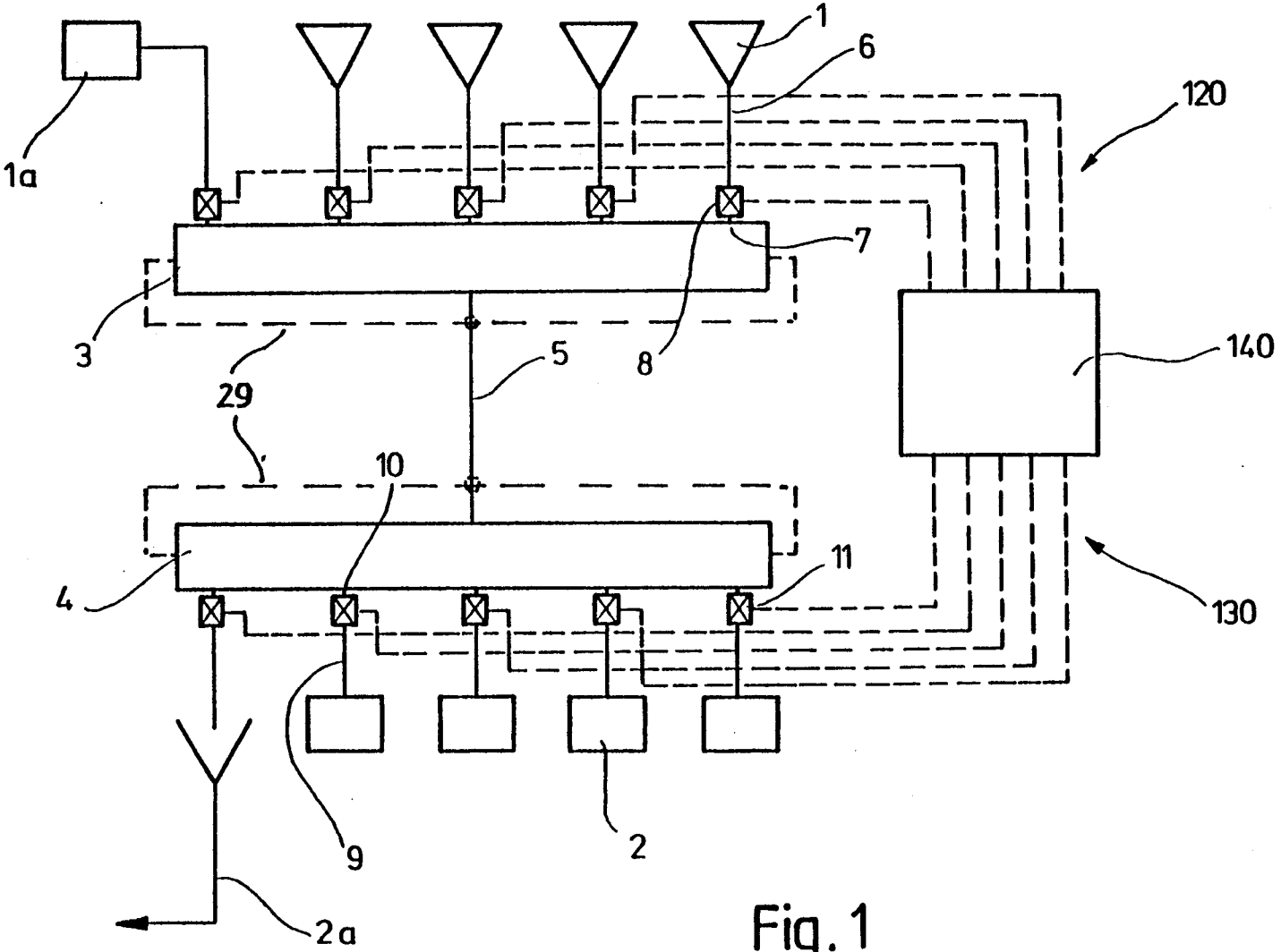
FIG. 1 is a schematic illustration of one embodiment of a processing-agent dispatching facility in accordance with the invention.

A simple embodiment of a facility for dispatching processing agents to several different textile-processing machines and pieces of equipment is schematically illustrated in FIG. 1. The various agents are accommodated in holding tanks equipped with mixers, heaters, etc. The machinery and equipment is centralized and integrated into a holding point 1. The textile-processing machinery and equipment are at separate processing points 2, which are to be considered accommodated inside a dye works for example. The precise number of holding points 1 and processing points 2 is not essential and will be dictated by the particular application.

Figure 3:
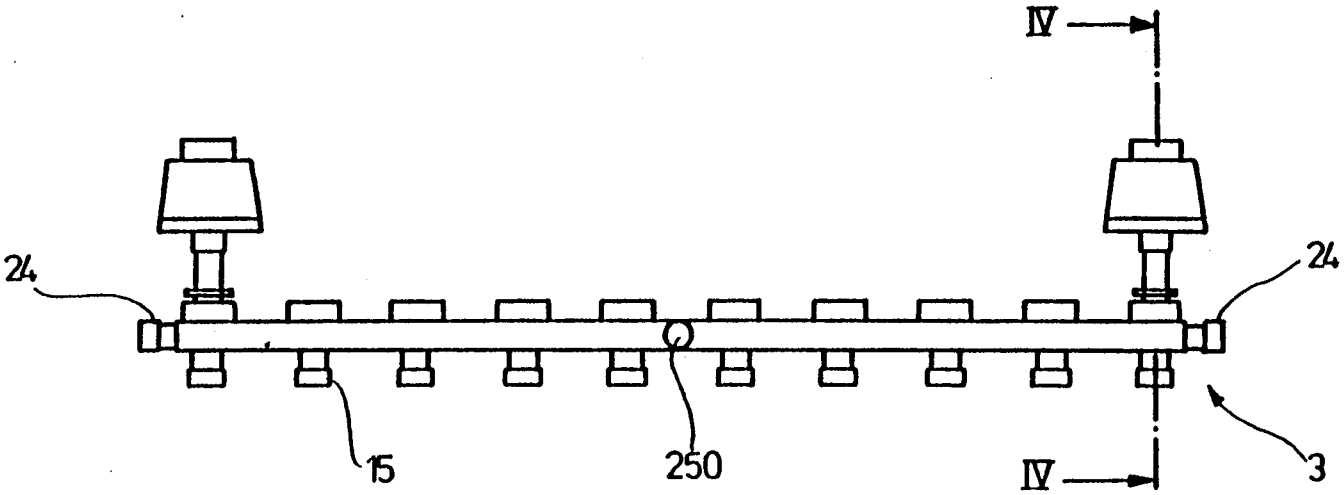
FIG. 3 is a side view of a header or distributor for the facilities illustrated in FIGS. 1 and 2.
Figure 4:
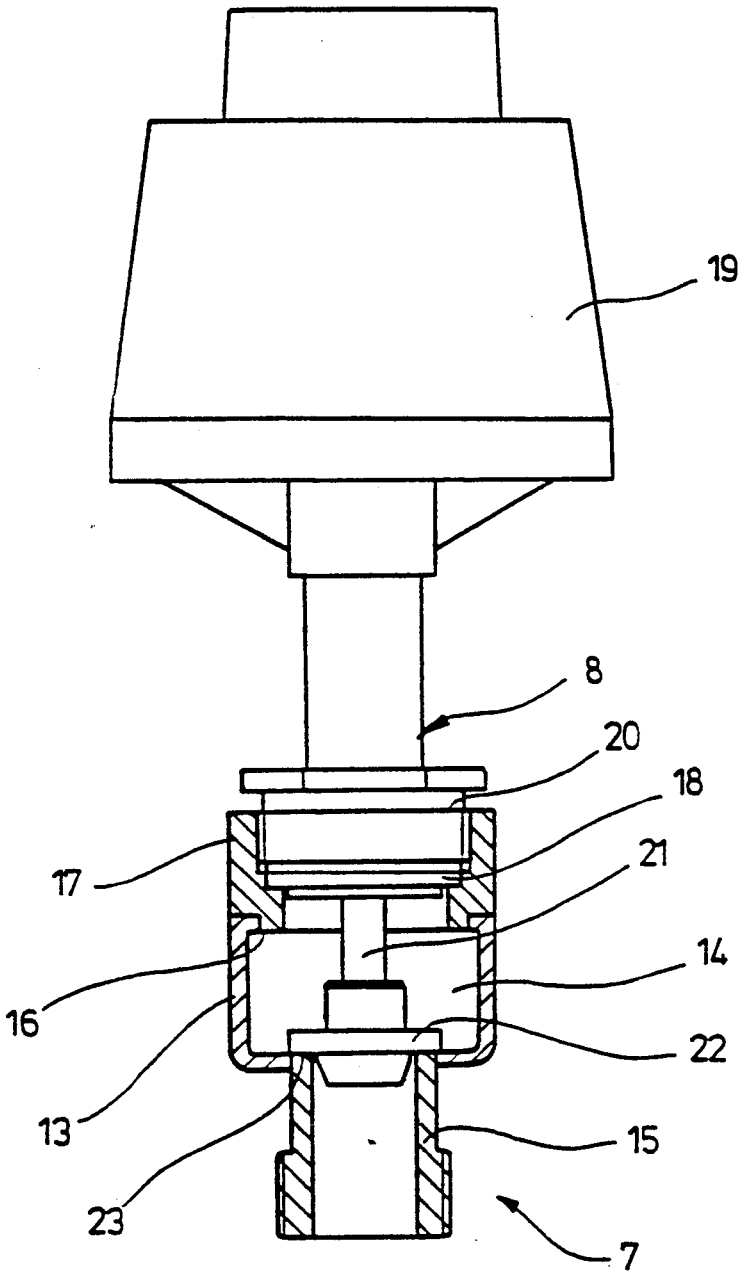
FIG. 4 is a larger-scale side view and section along the line IV—IV through the facility illustrated in FIG. 3.

The holding points 1 are combined into a header 3, which is illustrated only schematically in FIG. 1 and the details of which will be described hereinafter with reference to FIGS. 3 and 4.

A distributor 4, similar in structure to header 3, is similarly associated with processing points 2. Header 3 very generally comprises collecting means and is positioned directly adjacent to holding points 1. Distributor 4 very generally comprises distributing means and is positioned directly adjacent to processing points 2. Header 3 communicates with distributor 4 though a trunk 5 in the form of a common line.

Each holding point 1 communicates with header 3 through a branch 6 of with one of several connections 7 to the header. The connections accommodate controls in the form of valves 8 that vary the flow of processing agent through the connections. The valves can be selectively activated by electromagnets.

Distributor 4 communicates similarly with processing points 2 through branches 9 from connections 10. These connections accommodate controls in the form of valves 11 that vary the cross-section of each branch 9. These valves as well can be selectively activated by electromagnets.

Valves 8 are electrically connected by lines 120 and valves 11 by lines 130 to computerized overall controls 140. Controls 140 transmit signals to the valves that open and close them in accordance with a particular program.

Holding points 1 can accommodate instead of the aforesaid holding or dissolving tanks at least one dosimeter la that supplies prescribed volumes of processing agent at prescribed intervals to header 3 when its associate electromagnetic valve 8 is triggered by controls 140. Instead of textile-processing machinery or equipment, a rinse outlet 2*a* can communicate with distributor 4 by way of one connection 10.

The structure of header 3 and of the similarly constructed distributor 4 will now be briefly described with reference to FIGS. 3 and 4, which illustrate a header 3.

Header 3 comprises an elongated tubular housing in the form of a length 13 of box section with at least one interior manifold 14. Connections 7 in the form of connectors 15 open into manifold 14. Connectors 15 are distributed adjacent and at equal intervals along a plane in the vicinity of at least one wall of the tube.

The opposite wall of length 13 is provided with bores 16, each coaxial with a connector 15. A sleeve 17 fits tight in each bore 16. Each sleeve 17 accommodates a valve 8 in holder 18. The valve is activated by an electromagnet 19. It is secured in sleeve 17 by a threaded bushing 20. Adjacent valves 8 can be positioned closer together to save space or farther apart.

Each electromagnet 19 attracts a bolt 21 with a valve head 22 at the bottom. Head 22 fits into a seat 23 in the end of the associated connector 15.

The electromagnets 19 can be activated or released to open or close the communication between manifold 14 and a particular connector 15 with head 22. The design also makes it possible to replace the valves 8 individually without any changed in length 13 of box section or in connectors 15.

Length 13 is blocked off at each end by flanged connectors 24 that allow pipelines to be attached.

The flanged connectors 24 at each end of the simple embodiment of a processing-agent dispatching facility illustrated in FIG. 1 are intact. Length 13 is also provided with a branch 250, apparent in FIG. 3, that leads to trunk 5.

The simple trunk 5 illustrated in FIG. 1 is only one possible approach to forwarding processing agents from header 3 to distributor 4. It is employed when the collecting end of the facility can be positioned higher than the distributing end, so that the agents can be dispatched from their holding points 1 to their processing points 2 subject to gravity.

Depending on the demands of the particular site of employment and on the prevailing conditions, trunk 5 can also be provided with pumps, blowers, and/or other forwarding mechanisms that depend on other forms of power. Several parallel trunks can also be employed.

How the agent is dispatched from holding points 1 to processing points 2 will now be described. All valves 8 and 11 are initially closed. Controls 140 open at least one valve 8 into header 3 and at least one valve 11 out of distributor 4, establishing an itinerary between at least one holding point and at least one processing point. The itinerary extends through the associated branch or branches 6 and connection or connections 7 into the manifold or manifolds 14 inside header 3, on through forwarding trunk or trunks 5 into the manifold or manifolds 14 inside distributor 4, out through connection or connections 10, and in through branch or branches 9.

Once the processing agent or agents have been dispatched, controls 140 close the open valves 8 and 11, and the overall facility will be ready for the next dispatching procedure. Any holding point 1*a* can of course be further subject to a dosimeter.

Any processing point 2 can also have a rinse outlet 2*a*, and the overall facility can be rinsed out between dispatching procedures. In this event, one or more of the branches 9 leading out of distributor 4 will be diverted to their associated rinse outlet 2*a*. Distributor 4 can accordingly be thoroughly rinsed with little or no rinse penetrating into one or more processing points 2. The corresponding outlet from distributor 4 can of course also be employed for other purposes. Rinse can be left in all or part of the facility when practical subsequent to a rinsing procedure.

Figure 5:
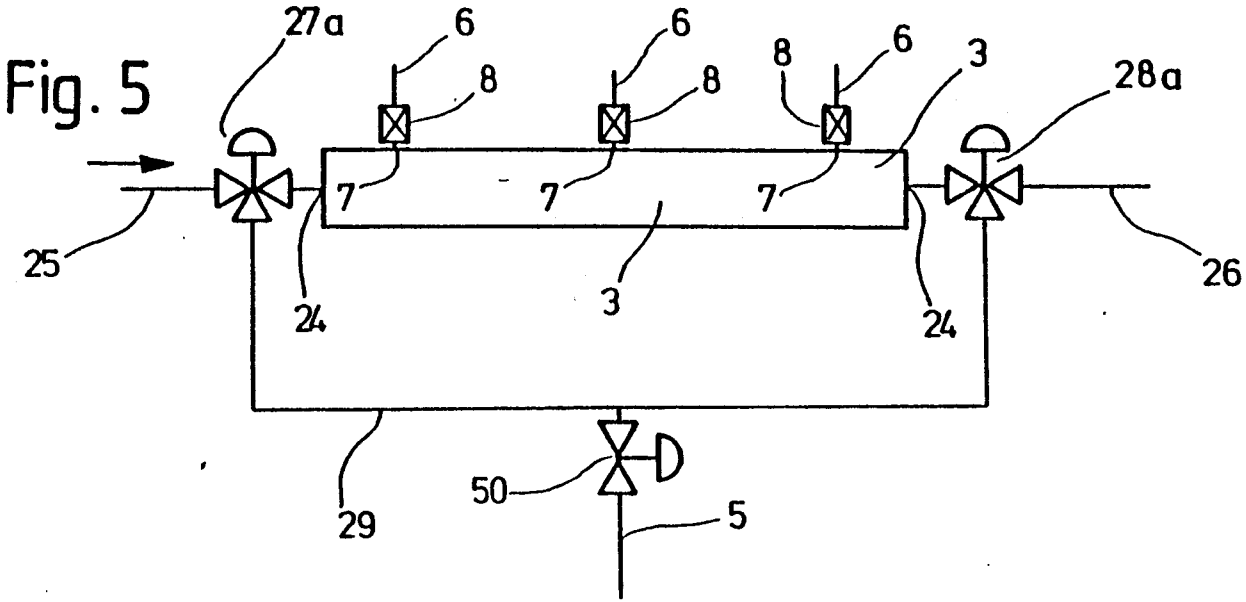
FIG. 5 is a schematic illustration of the header or distributor illustrated in FIG. 3 with its ends communicating through a bypass.
Figure 6:
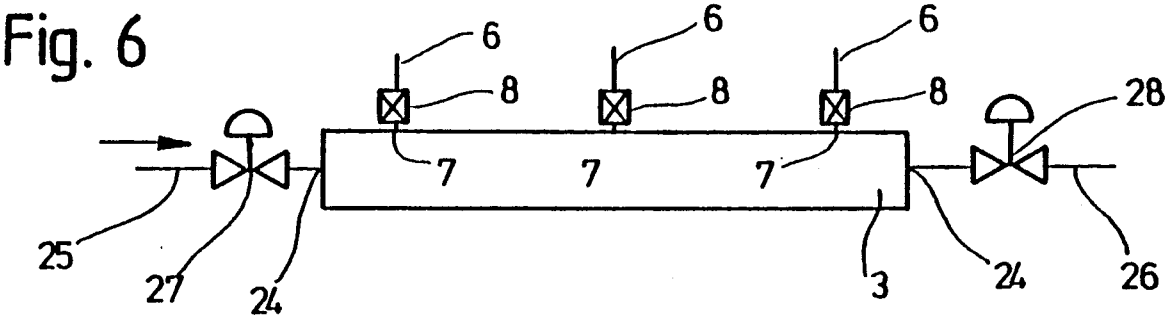

Header 3 and distributor 4 can also have special rinse intakes and outlets to allow rinse to be provided in accordance with specific requirements. FIGS. 5 and 6 illustrate such embodiments.

Rinse lines 25 and 26 can communicate with the flanged connectors 24 at each end of header 3 as illustrated in FIGS. 5 and 6.

The header 3 illustrated in FIG. 5 can be rinsed from both ends. Rinse lines 25 and 26 accommodate three-way valves 27 and 28*a* that also communicate through a bypass 29. Trunk 5 extends out of bypass 29 and accommodates another valve 50.

The header 3 illustrated in FIG. 6 can be rinsed in only one direction. Rinse line 25 accommodates a two-way valve 27 and rinse line 26 a two-way valve 28. With both valves open, the rinse will enter the header through rinse line 25 and leave through rinse line 26.

A similar system can be employed to rinse out distributor 4. The branch 250 illustrated in FIG. 3 is not used with the embodiment illustrated in FIG. 5 and need not be used with the embodiment illustrated in FIG. 6 if trunk 5 communicates with a flanged connector 24 through an appropriate valve.

In the simple embodiment illustrated in FIG. 1, all holding points 1 communicate with a single header 3, and a single distributor 4 communicates with all processing points 2. When, however, many processing points must be provided with many combinations of many processing agents, the facility can be considerably more complex of course.

Figure 2:
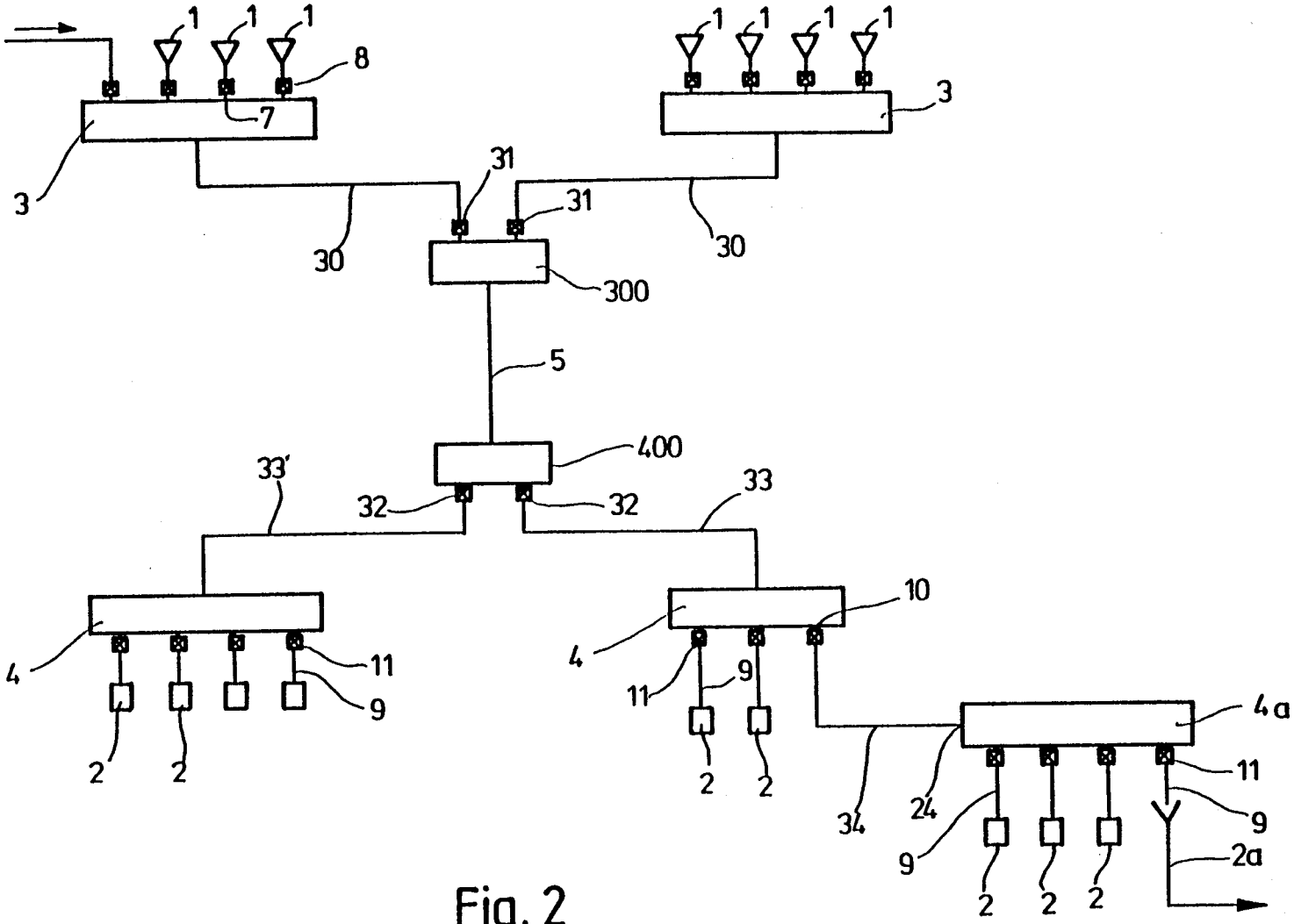
FIG. 2 is a schematic illustration of another embodiment of a processing-agent dispatching facility in accordance with the invention.

FIG. 2 illustrates one such complex facility. Similar components are labeled with the same reference number and will not be specified again.

Holding points 1 are combined into groups, two in the illustrated example. Each group communicates with a specific header 3. The two headers 3 in turn communicate through branches 30 and by wa of valves 31 electromagnetically activated by the controls 140 illustrated in FIG. 1 with a higher-echelon header 300. Higher-echelon header 300 communicates with a distributor 400 through a trunk 5. Distributor 400 communicates with two lower-echelon distributors 4 by way of valves 32, also activated by controls 140, and through branches 33. Each lower-echelon distributor 4 communicates with groups of processing points 2 by way of valves 11, also activated by controls 140, and through branches 9.

The headers accordingly constitute a contracting tree with a base consisting of a single header and communicate through the trunk with a single distributor that constitutes the base of an expanding tree of distributors.

One connection 10 on the distributor 4 illustrated on the right in FIG. 2, however, communicates through a line 34 with a subsidiary distributor 4a. The line enters the distributor through a flanged connector 24 at one end. Subsidiary distributor 4a in turn communicates with a group of processing points 2.

The processing-agent dispatching facility illustrated in FIG. 2 accordingly comprises a serial and parallel hierarchy of headers 3 and 300 and distributors 4, 400, and 4a. The illustrated embodiment is of course only one example of such a complex and intelligent facility and may be modified and supplemented as necessary.

For simplicity's sake, overall controls 140 and their lines 120 and 130 have been left out of FIGS. 2, 5, and 6 although part of the embodiments illustrated therein. They function as described with reference to FIG. 1. No matter what its precise structure, the facility that is the object of the present invention can be operated not only forward to service processing points 2, but also in reverse. In the latter mode, processing agents can be dispatched back and forth between any holding point 1 or group thereof and any processing point 2 or group thereof.

Each header 3 and 300 and each distributor 4, 400, and 4a in the complex facility illustrated in FIG. 2 can of course also be provided with a rinsing system of the aforesaid type and rinsed jointly or separately. One advantage of all the embodiments in fact is that points can be rinsed independently of one another.

To eliminate dead space it can also be practical to provide each header and distributor with a bypass 29 as illustrated in FIG. 5 with a trunk 5 between them as represented by the discontinuous lines in FIG. 1.

The present specification and claims are of course intended solely as illustrative of one or more potential embodiments of the invention and should not be construed as limiting it in any way. The invention may accordingly be adapted and modified in many ways that may occur to one of skill in the art without deviating from the theory behind it or exceeding the scope of its application.

We claim:

1. A method for dispatching agent or agents from at least one of a plurality of holding points (1) to at least one of a plurality of processing points (2), each of said holding points communicating with at least one header (3) through respective header input branches, each of said header input branches having a controllable input flow regulator (8), said at least one header (3) communicating with at least one distributor (4) through at least one long trunk (5), said distributor or distributors (4) communicating with each of said processing points (2) through respective distributor output branches, and each of said distributor output branches having an output controllable flow regulator (11), said method comprising:

selectively opening and closing individual input flow regulators (8), one at a time for said header or for each of said headers (3) to selectively open and block respective header input branches to establish first portions of flow itineraries from at least one of said plurality of holding points (1) to said at least one header (3);

selectively opening and closing individual output flow regulators (11) to open and block respective distributor output branches to establish second portions of flow itineraries from said at least one distributor (4) to at least one of said plurality of processing points (2);

dispatching each type of said agent or agents over an individual itinerary comprising one of said first and one of said second portions and said at least one long trunk (5) from a holding point (1) to a selected processing point (2) and selectively introducing a rinse fluid into at least one of: said at least one header and said at least one distributor selectively, before or after, or before and after agent has traveled through them.

2. The method according to claim 1, further comprising establishing a flow itinerary between at least one of group of holding points (1) and groups of processing points (2) by selectively opening and closing individual flow regulators (8, 11).

3. The method according to claim 1, wherein at least one of: the headers (3), the distributors (4) and the trunk (5) are left at least partially filled with rinse fluid subsequent to a rinsing.

4. The method according to claim 1, further comprising rinsing the headers (3) and distributors (4) with a rinse fluid whether or not an individual holding point (1) or processing point (2) is rinsed.

5. The method according to claim 1, further comprising rinsing the trunk (5) with the rinse fluid.

6. The method according to claim 1, further comprising returning agent from at least one processing point (2) to at least one holding point (1) over the flow itinerary established for flow from the at least one holding point (1) to the respective processing point (2).

7. The method according to claim 1, further comprising establishing at least one of serial and parallel flow itineraries between headers (3) and distributors (4).

8. The method of claim 3, further comprising establishing a flow connection from one of said holding points (1) to one of said processing points, after at least one of: the headers (3), the distributors (4) and the trunk (5) have been left at least partially filled with rinse fluid.

9. An apparatus for dispatching agent or agents over a selectively controllable individual itinerary, said apparatus comprising:

a pipeline system having a plurality of branches (6,7; 9, 10);

a plurality of input flow regulators (8) each respectively coupled to one of said plurality of branches (6, 7) forming header input branches for selectively opening and closing each of said plurality of branches;

at least one header (3);

a plurality of holding points (1) each communicating with the at least one header (3) through respective header input branches (6, 7), each controlled by a respective input flow regulator (8) of said pipeline system;

at least one distributor (4);

a plurality of processing points (2), each communicating with the at least one distributor (4) through respective other (9, 10) branches forming distributor output branches of said pipeline system;

a plurality of output flow regulators (11), each respectively coupled to another one (9, 10) of said plurality of distributor output branches for selectively opening and closing each of said distributor output branches;

at least one long trunk (5) for communicating said at least one header (3) with said at least one distributor (4);

control means (140) for individually controlling said flow regulators (8, 10) to selectively open and close branches of said pipeline system to establish an individual itinerary for the flow of each type of said agent or agents, one at a time for each header (3), from at least one of said plurality of said holding points (1) to said at least one header, from said at least one header through a said at least one long trunk (5) to said at least one distributor (4), and from said at least one distributor to at least one of said plurality of processing points (2) via a respective one of distributor output branches; and means (25, 26) for controllably introducing rinse fluid into at least one of said at least one header (3) and said at least one distributor (4).

10. The apparatus according to claim 9, wherein each of said headers (3) communicates with another header through a respective branch (6, 7) of said pipeline system or with said at least one distributor through said at least one trunk (5).

11. The apparatus according to claim 9, wherein each of said distributors (4) communicates with at least one of another distributor and one of said plurality of processing points (2).

12. The apparatus according to claim 9, wherein said control means (140) is electrically connected to each flow regulator (8, 11) for controlling the respective regulator or regulators.

13. The apparatus according to claim 9, wherein said holding points (1) are arranged in groups, each of said holding point groups communicating with a respective header (3), wherein said pipe line system includes means for communicating of at least one header (4) with another header, wherein at least one distributor communicates with another distributor;

and wherein said processing points (2) are arranged in groups and said pipe line system further includes means for communicating of each of said processing point groups with a respective distributor.

14. The apparatus according to claim 9, wherein said at least one trunk (5) is coupled to a trunk flow regulator (50) which is selectively openable and closeable by said control means (140).

15. The apparatus according to claim 9, wherein each header (3) and each distributor (4) includes a manifold (14).

16. The apparatus according to claim 15, wherein said holding points (1) and processing points (2) are arranged in respective groups, and each group communicates with a respective header or distributor through a manifold (14).

17. The apparatus according to claim 15, wherein each manifold (14) is accommodated in a tubular housing (13).

18. The apparatus according to claim 17, further comprising connections for accommodating each flow regulator (8, 11), the connections being distributed along a respective housing (13).

19. The apparatus according to claim 18, wherein each flow regulator (8, 11) comprises a valve, each valve communicating with a respective connection and includes a valve head element (22) located on the housing opposite the respective connection, and operable in conjunction with said respective connection.

20. The apparatus according to claim 17, wherein the means (25, 26) for introducing rinse fluid comprises connectors (24) communicating with at least one of: a rinse line, and said at least one trunk (5), said connectors being coupled to end portions of one or more of said housings (13) and includes means (27, 28; 27*a*, 28*a*) for regulating flow through the connectors (24) and positioned at least at one end of respective housings.

21. The apparatus according to claim 20, wherein connectors (24) at the ends of respective housings (13) communicate through a bypass (29).

22. The apparatus according to claim 21, wherein the bypass (29) further communicates with said at least one trunk (5).

23. The apparatus according to claim 15, wherein at least one of said plurality of holding points (1) includes a dosimeter (1*a*) for metering agent from the holding point, said dosimeter communicating directly with a respective connection into a respective manifold (14).

24. The apparatus according to claim 9, wherein the means (25, 26) for introducing rinse fluid comprises connectors (24) communicating with at least one of: a rinse line, and said at least one trunk (5); and means (27, 28; 27*a*, 28*a*) for regulating flow through said connectors which introduce the rinse fluid.

* * * * *